United States Patent [19]

Smith et al.

[11] Patent Number: 4,716,416

[45] Date of Patent: Dec. 29, 1987

[54] ANTENNA DISH REFLECTOR WITH INTEGRAL DECLINATION ADJUSTMENT

[75] Inventors: Edward W. Smith, Los Angeles; Gene Garfinkle, Newport Beach, both of Calif.

[73] Assignee: Satellite Technology Services, Inc., St. Louis, Mo.

[21] Appl. No.: 717,506

[22] Filed: Mar. 28, 1985

[51] Int. Cl.[4] ..... H01Q 15/16; H01Q 3/02

[52] U.S. Cl. ..... 343/915; 343/880; 343/882

[58] Field of Search ..... 343/880, 915, 882, 914, 343/765, 766, 878; 126/424

[56] References Cited

U.S. PATENT DOCUMENTS

| | | | |
|---|---|---|---|
| 2,472,824 | 6/1949 | Hays . | |
| 2,907,031 | 9/1959 | Meredith | 343/882 |
| 2,955,288 | 10/1960 | Palmer | 343/915 |
| 3,255,455 | 6/1966 | Von Trentini . | |
| 3,510,877 | 5/1970 | Turriere | 343/882 |
| 3,530,477 | 9/1970 | Jarrett et al. . | |
| 3,562,753 | 2/1971 | Tanaka et al. . | |
| 3,680,141 | 7/1972 | Karikomi . | |
| 3,713,164 | 1/1973 | Foury . | |
| 3,714,660 | 1/1973 | Scrafford et al. . | |
| 3,845,483 | 10/1974 | Soma et al. . | |
| 3,940,771 | 2/1976 | Wild . | |
| 3,987,452 | 10/1976 | Godet . | |
| 4,044,361 | 8/1977 | Yokoi et al. . | |
| 4,086,599 | 4/1978 | VanderLinden et al. . | |
| 4,118,707 | 10/1978 | Yoshida et al. . | |
| 4,126,865 | 11/1978 | Longhurst et al. | 343/766 |
| 4,199,762 | 4/1980 | Estlick et al. . | |
| 4,225,868 | 9/1980 | Mazur . | |
| 4,232,320 | 11/1980 | Savalle, Jr. | 343/882 |
| 4,251,819 | 2/1981 | Vickland . | |
| 4,282,529 | 8/1981 | Speicher . | |
| 4,304,381 | 12/1981 | Lloyd . | |
| 4,332,426 | 6/1982 | Speicher . | |
| 4,384,294 | 5/1983 | Crook et al. . | |
| 4,396,919 | 8/1983 | Speicher . | |
| 4,404,565 | 9/1983 | Gurney et al. . | |
| 4,433,337 | 2/1984 | Smith et al. . | |
| 4,442,435 | 4/1984 | Kiryu et al. . | |
| 4,450,450 | 5/1984 | Ellingson et al. . | |
| 4,454,515 | 6/1984 | Major et al. . | |
| 4,470,050 | 9/1984 | Ellingson et al. . | |
| 4,490,724 | 12/1984 | Bickman . | |
| 4,491,388 | 1/1985 | Wood . | |
| 4,491,847 | 1/1985 | Estang . | |
| 4,563,687 | 1/1986 | Berger | 343/882 |
| 4,598,297 | 7/1986 | Hawkins | 343/882 |
| 4,626,864 | 12/1986 | Micklethwaite | 343/766 |

FOREIGN PATENT DOCUMENTS

| | | | |
|---|---|---|---|
| 0129408 | 10/1981 | Japan | 343/878 |
| 0004601 | 1/1982 | Japan | 343/882 |
| 0095405 | 6/1983 | Japan | 343/880 |
| 0103405 | 6/1984 | Japan | 343/878 |
| 0158103 | 9/1984 | Japan | 343/878 |
| 0174001 | 10/1984 | Japan | 343/878 |
| 0003205 | 1/1985 | Japan | 343/880 |

*Primary Examiner*—Charles Frankfort
*Assistant Examiner*—Thomas B. Will
*Attorney, Agent, or Firm*—Rogers, Howell, Moore & Haferkamp

[57] ABSTRACT

An antenna system for a television reception only antenna includes an integral declination adjustment comprising an upper and lower curvilinear surface as part of the superstructure supporting the main reflector dish with an upper and lower pad rotatably mounted to a pivot tube providing surfaces matching the curvilinear surfaces against which the main reflector dish rests. Slots and holes are cut into the matching surfaces and a pair of nut and bolt assemblies extending through the slots and holes secure the surfaces once the proper declination angle has been achieved.

14 Claims, 5 Drawing Figures

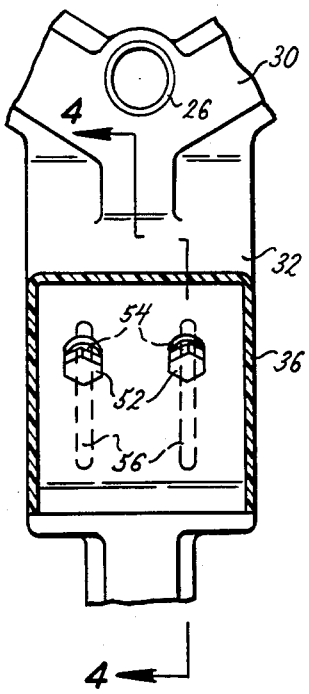
FIG. 3.
FIG. 5.
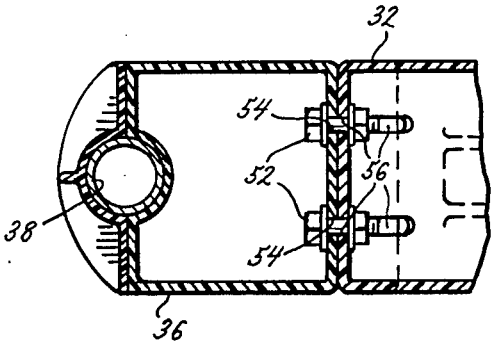
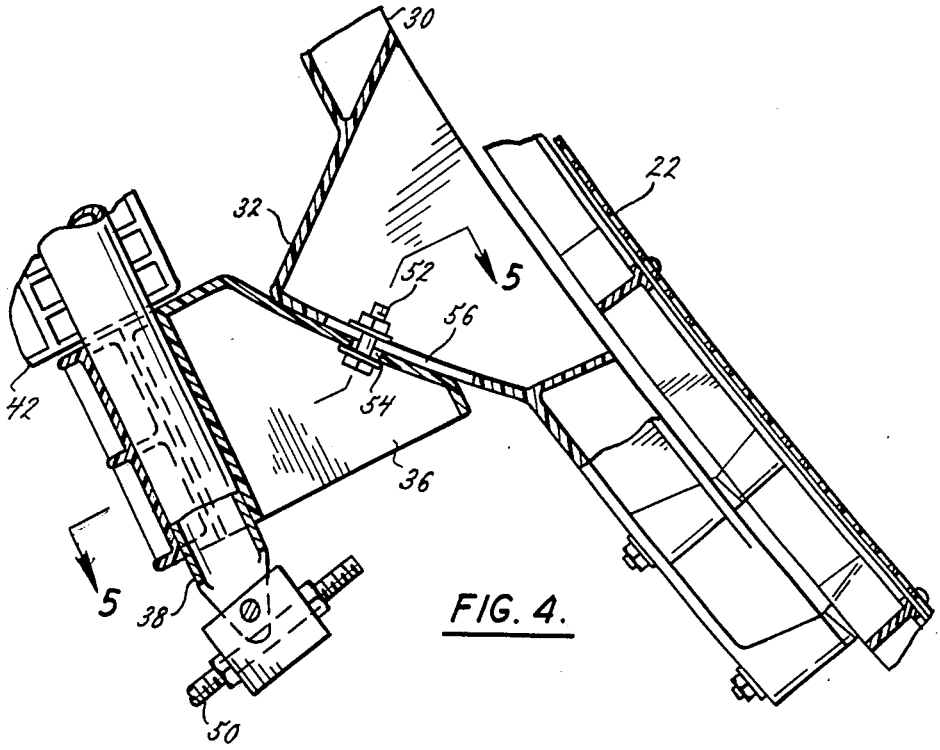
FIG. 4.

ANTENNA DISH REFLECTOR WITH INTEGRAL DECLINATION ADJUSTMENT

BACKGROUND AND SUMMARY

Antennas for use in satellite television reception only (TVRO) systems, are well known in the art. These dish-type antennas are used by a homeowner to receive satellite broadcast television programs from any one of a number of satellites in geosynchronous orbit over the equator. Each antenna includes as major components the dish or reflector which is oriented towards the satellite, and a feed which is located at the focal point of the dish. The dish or reflector ranges in size from approximately a four-foot diameter to an eleven-foot diameter and the antennas are generally mounted for rotational movement atop a pole which is anchored in a concrete pad or the like.

One of the reasons for the size of these main reflector dishes is that is is an important factor in determining the quality of the reception. The cross-sectional area of the main reflector dish projected into a plane defines the aperture of the dish, and the larger the aperture, the better the reception, all other things being equal. Therefore, a larger dish size adds to performance, but it creates problems focusing the dish on individual satellites, keeping the dish focused on the desired satellite, and also moving it from satellite-to-satellite at the operator's command. As the wind picks up velocity, the antenna has a tendency to shift, drift or oscillate, a phenomenon known as mispointing, such that the television reception is degraded. Therefore, it is important to be able to accurately, reliably, and rigidly point and move the dish in spite of the wind.

In each antenna's installation, there are three adjustments which must be made to properly orient the antenna to track the arc of satellites. These include elevation, declination, and azimuth. Elevation is the angle that the axis of rotation forms with respect to horizontal. Declination represents the angle that the center axis of the dish forms with respect to the axis of rotation. Azimuth represents the horizon-to-horizon movement of the antenna as necessary to move from one satellite to another. The azimuth movement is generally motorized and is the one adjustment made by the homeowner after the antenna is installed. The elevation and declination adjustments are initially made, and should remain unchanged after the antenna is properly installed.

The declination adjustment is typically achieved by one of two schemes in the prior art. In a first scheme, an elongated threaded bolt extends from a point on the dish to part of its back-up structure, and the dish may be tilted by moving a double-nut connection between the threaded bolt and the dish. This scheme suffers from several drawbacks. First of all, the center of mass of the entire reflector dish is altered as the dish is tilted to adjust the declination. Because of the necessity to stabilize the antenna in the wind, a declination adjustment which alters the center of mass of the dish requires that supporting structure be necessarily designed to handle the entire range of declination adjustment. Obviously, some declination adjustments will be better stabilized than others, and the antenna will suffer from reduced performance depending upon the particular required declination. Still another disadvantage of this design is that the declination adjustment provided by the threaded bolt does not exhibit a great deal of vernier control. This makes it somewhat difficult to achieve the proper declination upon installation.

Still another scheme utilized in prior art antennas is a swivel connection made at the very center of the dish to a supporting structure. This requires that the entire weight of the dish be held in place as the nuts are tightened in the swivel joints, something that can be very difficult to do given the weight of the dish. Furthermore, the pivoting arrangement provides a constant torque in a direction tending to loosen the declination adjustment such that its reliability over time is not great. The weight of the dish, and the forces placed on it by the wind all have a tendency to loosen the declination adjustment and shift the antenna dish off the arc of satellites. This results in a degradation of the received signal.

To solve these and other problems in the prior art, the inventors herein have succeeded in designing and developing an antenna system which represents a significant improvement over those designs heretofore known. In the design of the present invention, the main reflector dish has a back-up structure with an upper and lower curvilinear surface. These curvilinear surfaces rest against an upper and lower pad, with slots and holes cut in the surfaces and pads to permit the insertion of nut and bolt assemblies. Thus, the full weight of the antenna dish rests on an upper and lower pad surface, and the nuts may be loosened on the bolt assemblies to permit the whole antenna dish to slide against the pads to change the declination adjustment. As can be appreciated, this provides a significant improvement over the declination adjustments found in the prior art. First of all, this declination adjustment is integral with the antenna reflector dish and its pivotal mount. There is a frictional engagement between the curvilinear surfaces and the pads which more evenly distributes the load of the antenna on its mount to thereby diminish the potential for slippage of the antenna dish after it is once adjusted. Because of the sliding action of the antenna dish with respect to the pads, virtually the same center of mass is maintained across the entire declination adjustment which reduces the deleterious effect on wind stability as in the prior art. The entire weight of the antenna dish is supported by the pads, and the nut and bolt assemblies may be only slightly loosened to permit the easy sliding movement of the antenna dish on the pad surfaces until the proper declination has been achieved. At that time, the antenna dish may be locked in place by tightening the nut and bolt assemblies. Thus, it is a simple matter to adjust the declination with the invention of the present design as it does not require an operator to support the weight of the main reflector dish while tightening the declination adjustment structure.

The principal advantages and features of the present invention have been described. However, a greater understanding and appreciation for the invention may be obtained by referring to the drawings and detailed description of the preferred embodiment which follows.

BRIEF DESCRIPTION OF THE DRAWINGS

FIG. 3 is a partial cross-sectional view taken along the plane of line 3—3 of FIG. 2 and detailing the slots and holes cut in the pad and curvilinear surface;

FIG. 4 is an enlarged cross-sectional view taken along the plane of line 4—4 in FIG. 3 of a curvilinear and pad surface bolted together with a nut and bolt assembly; and FIG. 5 is a top view of the pad detailing the bolt assemblies.

DETAILED DESCRIPTION OF THE PREFERRED EMBODIMENT

Figure 1:
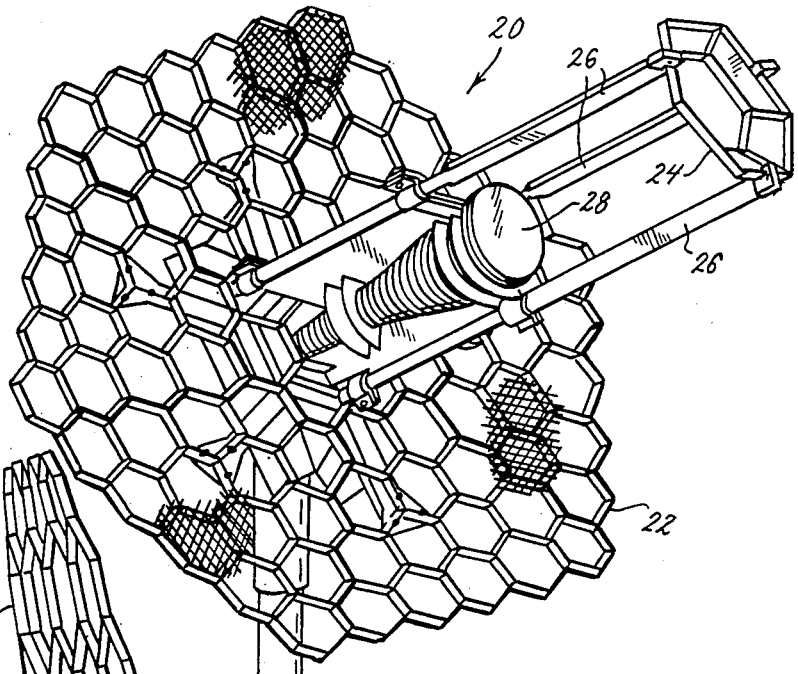
FIG. 1 is a perspective view of an antenna utilizing the declination adjustment of the present invention.
Figure 2:
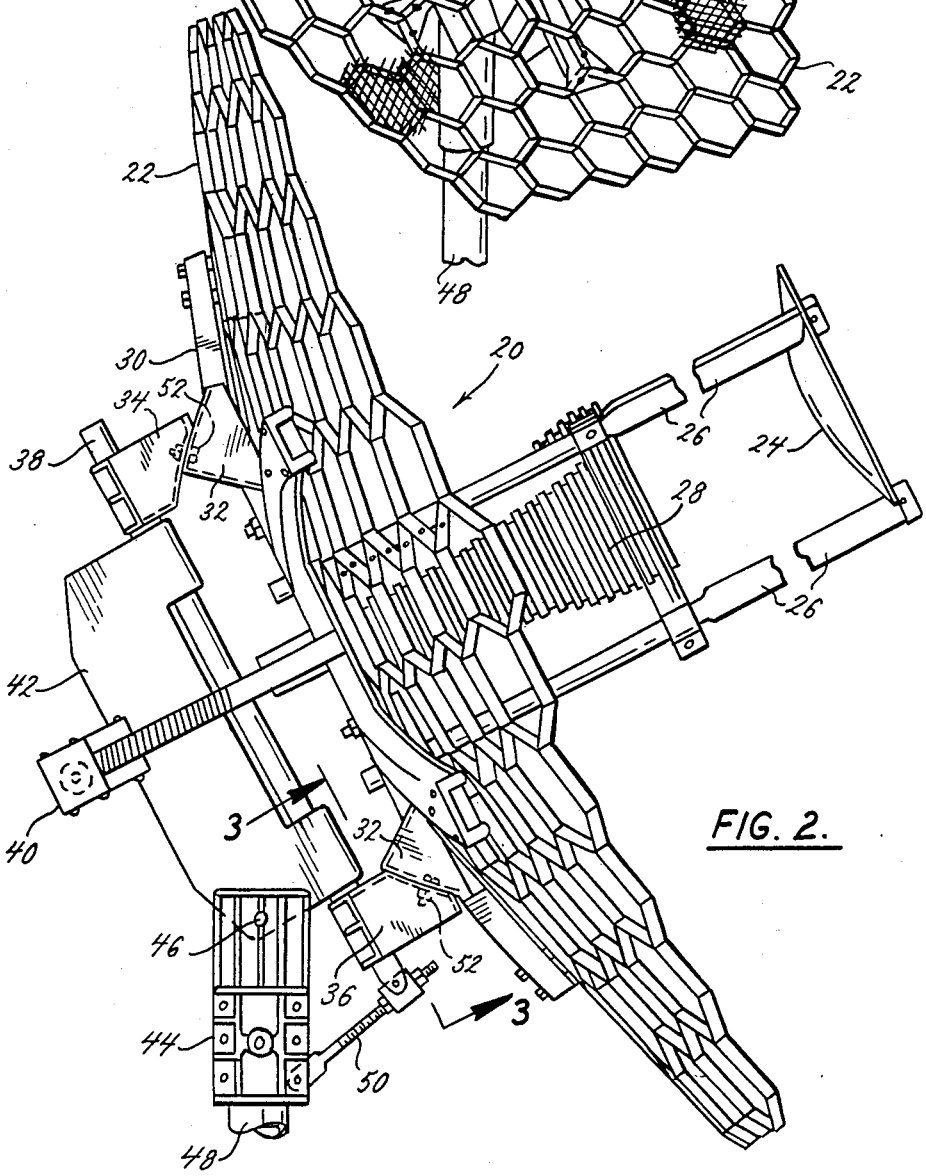
FIG. 2 is a side elevational a view of the antenna further detailing the pads, curvilinear surfaces, and nut and bolt assemblies securing same.

As shown in FIGS. 1 and 2, an antenna 20 for use in a satellite television reception only application includes a main reflector dish 22, a subreflector 24 supported by three spars 26, and a horn 28. The main reflector dish 22 has a supporting superstructure 30 which includes an upper and lower curvilinear surface 32 which rests against an upper pad 34 and a lower pad 36 pivotally mounted to pivot tube 38. An azimuth track and drive assembly 40 is bolted to the superstructure 30 and rides on U-connector 42 which is also pivotally secured to pivot tube 38. A pivot yoke 44 with nut and bolt assembly 46 supports the U-connector 42 atop mast 48, with elevation rod assembly 50 extending between pivot yoke 44 and pivot tube 38 to provide elevation adjustment. Thus, elevation adjustment is provided by elevation rod assembly 50, azimuth adjustment is provided by the azimuth track and drive assembly 40 which rotates the main reflector dish 22 about pivot tube 38, and declination adjustment is provided by the curvilinear surfaces 32 and pads 34, 36 with nut and bolt assemblies 52 securing same.

As shown in greater detail in FIGS. 3, 4 and 5, a pair of holes 54 are cut into upper and lower pads 34, 36 and slots 56 are cut in upper and lower curvilinear surfaces 32 with nut and bolt assemblies 52 extending therebetween to secure them in position. It is anticipated that nut and bolt assemblies 52 will be hand tightened to permit sliding movement between curvilinear surfaces 32 and pads 34, 36 as the declination is adjusted. Thus, the main antenna reflector dish 22 may be easily slid in an arc about these surfaces 32, 34, 36 until the proper declination angle has been achieved. Upon achieving the correct declination, the nut and bolt assemblies 52 may be tightened and the main reflector dish 22 is thus fixed in its angular orientation with respect to pivot tube 38 as is necessary to adjust declination.

There are various changes and modifications which may be made to applicants' invention as would be apparent to those skilled in the art. However, any of these changes or modifications are included in the teaching of applicants' disclosure and they intend that their invention be limited only by the scope of the claims appended hereto.

What is claimed is:

1. An antenna for receiving satellite broadcast data, the antenna comprising a main reflector dish, means to rotatably mount said main reflector dish from a support, said support comprising a rod means defining an axis of rotation of said dish to adjust the azimuth thereof, said rotatable mounting means including integral means to adjust the declination of the dish with respect to the support, the declination adjust means comprising an upper and lower pad means rotatably secured to the rod means, an upper and lower surface secured to the dish, and means to mount said upper and lower surfaces to said upper and lower pads.

2. The device of claim 1 wherein one of each of the pads and surfaces have means defining a slot therein, and means defining a hole in the other of each of the pads and surfaces, the surface mounting means comprising means for insertion through said slots and holes.

3. The device of claim 2 wherein the surface mounting means comprises a plurality of nut and bolt assemblies.

4. The device of claim 3 wherein the rod means comprises a pivot rod and wherein each of the upper and lower pads have a curvilinear surface, said upper and lower surfaces being curvilinear to match said pad curvilinear surfaces so that said upper and lower surfaces slideably support the dish from the upper and lower pads.

5. The device of claim 4 wherein the slots are in the upper and lower surfaces and the holes are in the upper and lower pads.

6. The device of claim 5 wherein the antenna is for a television reception only (TVRO) application.

7. An antenna for use in a satellite television reception only (TVRO) system, said antenna comprising a main reflector dish, the main reflector dish having an upper and lower curvilinear surface at its rear, an upper and lower pad, a rod means, said upper and lower pads rotatably mounted to said rod means, each of said pads having a curvilinear surface to match the upper and lower curvilinear surfaces on said dish, and means to secure said upper and lower surfaces to said upper and lower pads, said securing means having means permitting sliding movement between said surfaces and pads to thereby adjust the declination of the dish with respect to the rod means.

8. The device of claim 7 wherein one of each of the pads and surfaces has means defining a slot therein, and means defining a hole in the other of each of the pads and surfaces, said securing means including means for insertion through said slots and holes to secure said pads and surfaces.

9. The device of claim 8 wherein the insertion means comprises a plurality of nut and bolt assemblies.

10. The device of claim 9 wherein the slots are in the upper and lower surfaces and the holes are in the upper and lower pads.

11. In an antenna for receiving satellite broadcast data, the antenna comprising a main reflector dish, said main reflector dish having a supporting superstructure, and means to rotatably mount said supporting superstructure from a support, the improvement comprising means integral with said supporting superstructure to adjust the declination of the dish with respect to the support, said integral declination adjustmnet means comprising upper and lower pads rotatably secured to said support, each of said pads having a curvilinear surface, said supporting superstructure having matching upper and lower curvilinear surfaces, and adjustment means to permit slideable adjustment of said pad curvilinear surfaces and said supporting superstructure curvilinear surfaces to thereby adjust the declination of the dish with respect to the support.

12. The device of claim 11 wherein the adjustment means includes a slot in one of each of the pads and supporting superstructure curvilinear surfaces, and means defining a hole in the other of each of the pads and supporting superstructure curvilinear surfaces, and means for insertion through said slots and holes.

13. The device of claim 12 wherein the insertion means comprises a plurality of nut and bolt assemblies.

14. The device of claim 13 wherein the support comprises a pivot rod, said upper and lower pads including cylindrical openings therethrough so that said pads may be slid onto said pivot rod.

* * * * *